US005289162A

United States Patent [19]

McDaniel

[11] Patent Number: 5,289,162

[45] Date of Patent: Feb. 22, 1994

[54] EMERGENCY CONDITION AND DOOR AJAR ALARM FOR APPLIANCES

[76] Inventor: Steven M. McDaniel, 3307 Stoney Mist, San Antonio, Tex. 78247

[21] Appl. No.: 920,827

[22] Filed: Jul. 27, 1992

[51] Int. Cl.[5] ..... G08B 21/00; G08B 19/00

[52] U.S. Cl. ..... 340/521; 340/540; 340/545; 340/573; 340/815.69

[58] Field of Search ..... 340/545, 540, 573, 815.21, 340/521

[56] References Cited

U.S. PATENT DOCUMENTS

| | | | |
|---|---|---|---|
| 4,367,461 | 1/1983 | Gauchard | 340/573 |
| 4,528,558 | 7/1985 | Steers et al. | 340/686 |
| 4,566,285 | 1/1986 | Tershak et al. | 62/129 |
| 4,691,195 | 8/1987 | Sigelman et al. | 340/545 |
| 4,707,684 | 11/1987 | Janke et al. | 340/530 |
| 4,855,721 | 8/1989 | Hallett et al. | 340/585 |
| 4,891,626 | 1/1990 | Neuman | 340/547 |
| 4,894,643 | 1/1990 | Thompson et al. | 340/593 |

*Primary Examiner*—Glen R. Swann, III
*Attorney, Agent, or Firm*—Gunn, Lee & Miller

[57] ABSTRACT

A combination of a freezer/refrigerator appliance door ajar alarm indicating system with an appliance occupant emergency condition indicating system in a single unit utilizes two visual indicator means, one for each of the emergency conditions, and an audio alarm means with two tone operation, one for each of the emergency conditions indicated. The alarm system incorporates a first light indicator means in conjunction with a first audio alarm means that is triggered in response to a door ajar condition switch is being activated for longer than a preset period of time. The time period before the alarm is triggered may be adjusted by means of timer circuitry. The alarm system also incorporates a manually operated switch installed on the interior of the appliance that allows an occupant of the appliance to indicate to those on the outside the existence of an emergency condition that requires assistance. The occupant emergency alarm system also incorporates a visual indicator means comprising a second light attached near, but distinctive to the visual alarm indicator for the door ajar system. The occupant emergency alarm system also incorporates a trigger to the audio circuitry that initiates an audible alarm signal of a characteristic distinctive of that initiated for the door ajar system.

10 Claims, 3 Drawing Sheets

EMERGENCY CONDITION AND DOOR AJAR ALARM FOR APPLIANCES

BACKGROUND OF THE INVENTION

1. Field of The Invention

The present invention relates generally to contained environmentally controlled appliances such as refrigerators and freezers. The present invention relates more specifically to a device for providing an audible and visual alarm when an emergency condition exists within a container appliance and a distinctive audible and visual alarm when the appliance door is ajar for more than a certain period of time.

2. Description of the Related Art

There are generally two critical problems that can occur with large stationary container appliances such as refrigerators and freezers that immediately demand the attention of a person in a position to rectify the problem within the appliance. The first of these situations occurs when a door to the appliance has been left ajar for a period of time sufficient to affect the stability of the environment within the appliance and the integrity of whatever is being kept within the appliance. The second condition occurs when an individual, either because of the typical latching features of such appliance doors, or because the door becomes blocked from the outside, or because the individual inside is otherwise unable to open the door, becomes trapped within the appliance and runs the risk of prolonged exposure to low temperatures or suffocation due to their inability to exit.

In either of the above referenced situations, it is imperative that someone capable of rectifying the situation is alerted to the condition in time to prevent damage to the appliance and or its contents or to extricate the individual who might have become trapped. While access to large cooling container appliances such as freezers and refrigerators is necessary for their efficient use, the maintenance of this access way between the inside and outside of the appliance for anything longer than a very short period of time can greatly increase the expense of operating the appliance.

Likewise, in an effort to adequately seal the apertures through which access is maintained, such appliances are normally manufactured with very tight fitting doors and latch mechanisms that are sometimes operable only from the outside of the appliance. It is also possible that an individual working within the freezer or refrigerator might become injured in a manner that would prevent him from being able to open the door even if it were structured to be opened from the inside. Becoming trapped within the appliance, therefore, creates the immediate concern of exposure or suffocation for the trapped occupant. Unless attention can be called to the situation and someone on the outside of the appliance can open the door, serious injury or death could result.

It is well known in the field to provide an alarm system for indicating when a door to such an appliance has been left open for more than a preselected period of time. The mechanisms for triggering the alarm range from simple time delay circuitry that is initiated when the door is opened and remains opened for a period of time, to thermal switches that sense the temperature within the appliance and trigger an alarm when the temperature deviates from some preselected range. Depending upon the requirements of the contents of the appliance and the exchange of heat that results from the opening of the door, the time delay could be anywhere from a few seconds to more than a few minutes. The alarm associated with indicating that the door is ajar is typically a light indicator that turns on steadily or flashes so as to attract attention. It is also known to use audible alarms to indicate that the appliance door is ajar.

For very large refrigerators and freezers such as those used in cold storage warehouses and in grocery store coolers, it is often necessary to enter and exit the appliance for the purpose of storing or removing products from its interior. This process normally requires that one or more individuals enter the appliance and, at times, close the door behind them. While some newer walk-in freezers and refrigerators are constructed with latching mechanisms that can be opened from the interior, a good number of older and even some new freezer and refrigerator units do not anticipate the possibility of an individual being trapped inside. It is, therefore, desirable to have some means whereby an individual who does become trapped inside is capable of notifying those on the outside that they are in need of assistance. Even with the possibility that a door latch could be opened from the inside, the failure of such a latch to open as it is structured to do, would have consequences much more severe than usual because of the conditions within the freezer/refrigerator. The above described situation the occupant is unable to operate the appliance door due to a fall or other injury or because the door is blocked from the outside, also creates a condition with severe consequences.

It is, therefore, desirable, even with an appliance door that may normally be opened from the inside to have a means whereby an occupant of the freezer or refrigerator can signal the outside if the door latch means fails or for some other reason they are unable to open the appliance door.

These two situations, therefore, are the most common and the most serious conditions for which an alarm or other indicator means is appropriate during the operation of a freezer/refrigerator unit. While alarms of either the audio type or visual type are known for each of these situations, the devices previously described suffer from a number of limitations. Very often, the alarm systems are so complex and expensive to implement that they require significant initial costs for installation or significant maintenance costs or both. It is also typical to have to install separate alarm systems for each of the indicated situations that often results in increased costs and some duplication of effort.

It would be advantageous, therefore, to have a single alarm system for refrigerator and freezer appliances that incorporates both a system for notifying the operators of the appliance when the door to the appliance is ajar or open for an extended period of time and when there exists a situation within the appliance that requires immediate attention or assistance.

SUMMARY OF THE INVENTION

It is, therefore, an object of the present invention to provide the combination of a container type appliance door ajar alarm system with a container type appliance emergency condition alarm system in a single visual and audible indicator unit.

It is another object of the present invention to provide a means for alerting the operator of a refrigerator or freezer appliance to a door ajar condition that will detrimentally affect the efficient operation of the appliance.

It is another object of the present invention to provide both a visual and an audible alarm indicator means to alert the operator of an appliance to a door ajar condition that will detrimentally affect the efficient operation of the appliance.

It is another object of the present invention to provide a means for assisting the energy management and conservation of an appliance by providing a means for minimizing thermal losses from the interior of cooling appliances.

It is another object of the present invention to provide both a visual and an audible alarm indicator means to alert the operator of an, appliance to a condition within the appliance that requires immediate outside assistance.

It is another object of the present invention to provide the combination of a door ajar alarm indicator means and a emergency condition indicator means within a single unit that allows the observer or individual hearing the alarm to distinguish between each of the two emergency situations.

It is another object of the present invention to provide both a visual and an audible alarm indicator means for both an appliance door ajar condition and an occupant emergency condition that allows the appliance operator to hear and/or see the alarm and to distinguish between each of the emergency conditions, and to provide such a combination of alarm systems at low cost and in a low profile enclosure.

In fulfillment of these and other objectives, the present invention provides the combination of a freezer/refrigerator appliance door ajar alarm indicating system with an appliance occupant emergency condition indicating system in a single unit that utilizes two visual indicator means, one for each of the emergency conditions, and an audible alarm means of two tone operation, one tone for each of the emergency conditions indicated. The present invention incorporates a first light indicator means in conjunction with a first audible alarm means that is triggered in response to a door ajar condition switch being opened for longer than a preset period of time. The time period before the alarm is triggered may be adjusted by means of a timer circuitry and may be determined by the appliance operator.

The present invention also incorporates a manually operated switch installed on the interior of the appliance that allows an occupant of the appliance to indicate to those on the outside the existence of an emergency condition that requires assistance. This second alarm system also incorporates a visual indicator means in the form of a second light attached near, but distinctive from the visual alarm indicator for the door ajar condition. Likewise, the emergency condition alarm system incorporates a trigger to the audio circuitry that initiates the mission of an audible alarm signal of a tone distinct from that initiated for the door ajar system. There is no timer delay circuitry incorporated into the emergency condition system.

The present invention provides both of these alarm systems in a single unit that is both low in cost and low in physical profile. The present invention incorporates a large speaker unit with associated audio electronics mounted in a position adjacent the door of the appliance with a first light indicator means on one side of the speaker unit and a second light indicator means on an opposite side of the speaker unit. A door switch is connected to the electronics of the alarm unit from a standard door ajar switch and an occupant emergency condition connection is made from a manually operated switch within the appliance to the electronic circuitry of the alarm device.

These and other objects of the present invention will become apparent from a review of the detailed description of the preferred embodiments and the appended claims.

DETAILED DESCRIPTION OF THE PREFERRED EMBODIMENT

Figure 1:
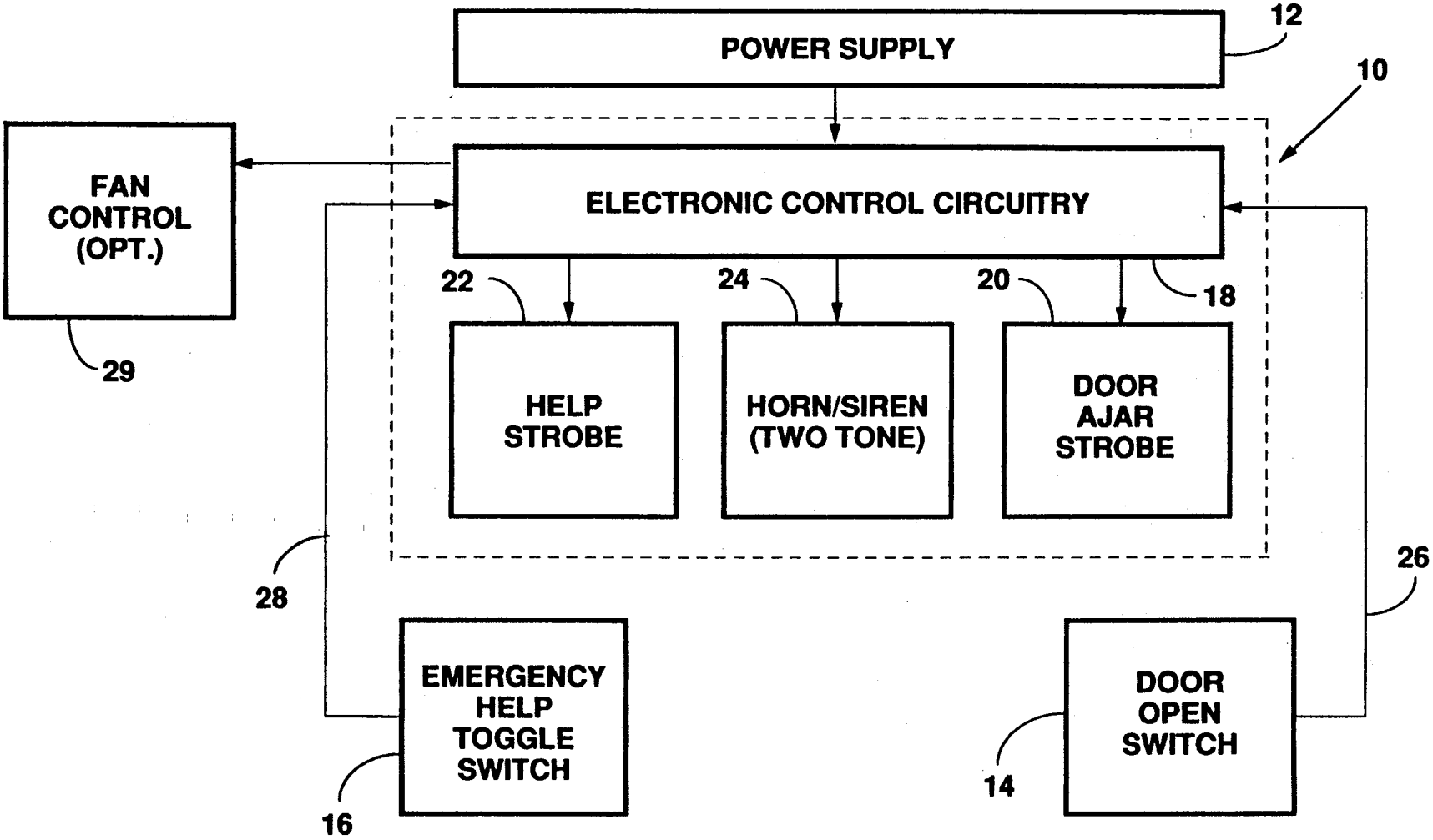
FIG. 1 is a block diagram showing the various components of the apparatus of the preferred embodiment of the present invention.

Reference is first made to FIG. 1 for a detailed description of the overall system and the various components that together make up the alarm apparatus of the present invention.

Combination alarm unit (10) is enclosed in a single enclosure and is connected to a number of external units. Alarm unit (10) is mounted in a central, highly visible position, typically above the door of the appliance of concern, External power supply (12) provides the necessary electrical power to both the electronic circuitry of combination alarm unit (10) and the audio and visual indicators (described below) that are incorporated in alarm unit (10).

Externally connected to combination alarm unit (10) are door switch (14) and occupant emergency toggle switch (16). Door switch (14) is normally in a deactivated position when the appliance door is closed and is activated when the appliance door is opened. Occupant emergency toggle switch (16) is manually thrown and is normally in a deactivated position. Operation of occupant emergency help toggle switch (16) by an occupant of the appliance activates switch (16).

Power supply (12) may be either a simple AC electrical connection to an available 110 AC, 60 Hz, current source or may be a self contained DC power supply appropriate to the components of combination alarm unit (10).

Alarm unit (10) itself is comprised of electronic control circuitry (18), door ajar indicator (20), occupant help strobe indicator (22), and horn/siren alarm (24). The condition of door switch (14), external to combination alarm unit (10), is sensed by electronic control circuitry (18) through electrical connection (26). The condition of occupant emergency toggle switch (16) is sensed by electronic control circuitry (18) by way of electrical connection (28). Electronic control circuitry (18) in turn conveys an appropriate electrical voltage to activate door ajar indicator (20) when such a condition is required, and to activate help strobe (22) when such a condition is required. Simultaneous to providing either or both of the visual indicators (20) and (22) with appropriate activating voltages, electronic control circuitry (18) provides horn/siren alarm (24) with an electrical activating signal of an appropriate voltage and frequency to provide an audible alarm. Electronic control circuitry (18) includes a timer appropriate to delay the initiation of a door ajar alarm and a pulse circuitry for strobing the visual alarm indicators. The details of the electronic control circuitry are described below.

Optionally connected to electronic control circuitry (18) and external to alarm unit (10), is fan control (29). Either or both of the conditions that are sensed by the system of the present invention make appropriate the control of fans that help determine the condition of the environment within the appliance. Depending on the specific appliance requirements, alarm unit (10) may, as appropriate, activate or deactivate fan units in the appliance by way of fan control (29).

Figure 2:
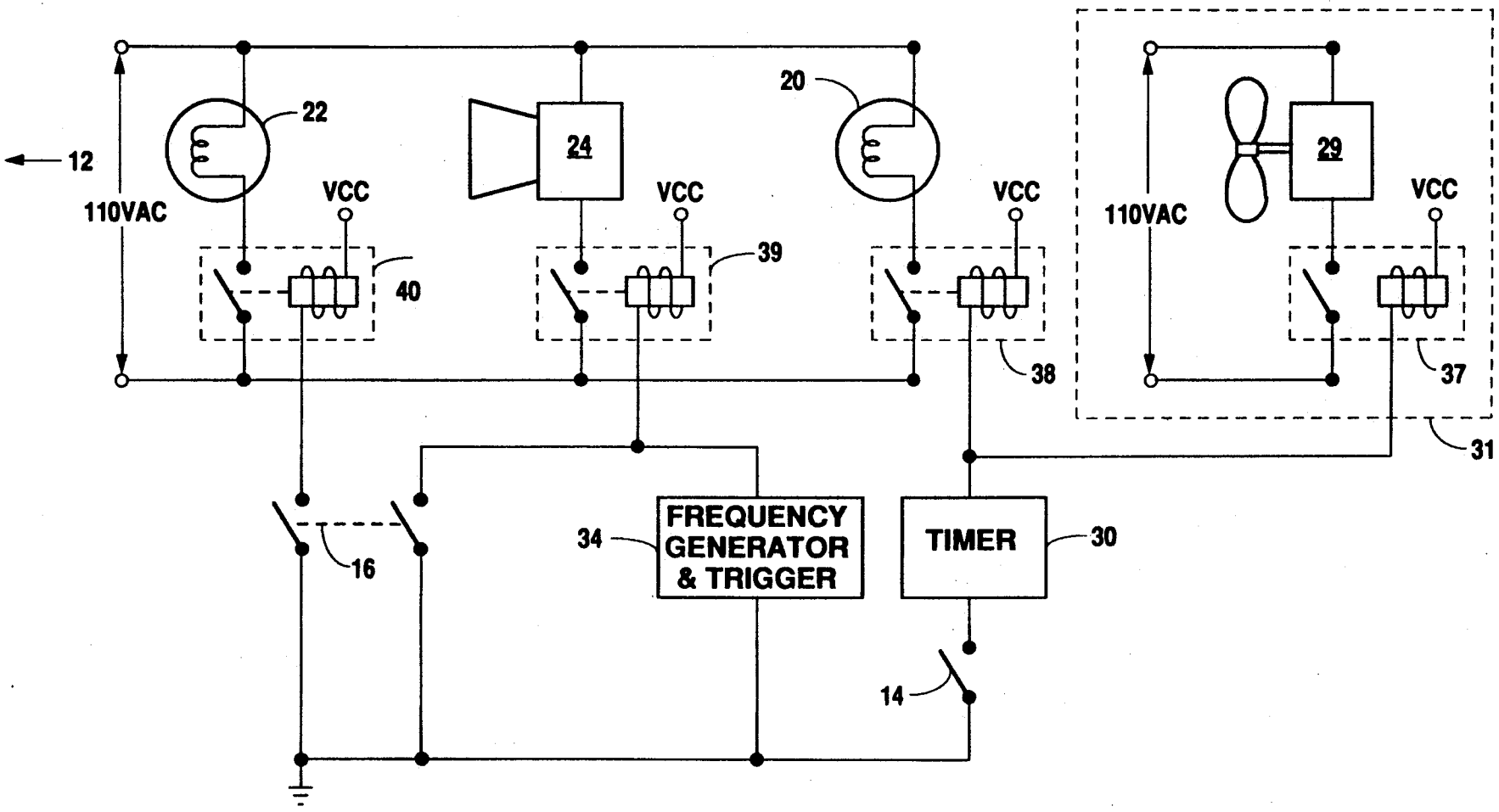
FIG. 2 is a schematic diagram of the electronic circuitry associated with each of the various components of the apparatus the present invention.

Reference is now made to FIG. 2 for a detailed description of the electronic circuitry associated with the preferred embodiment of the present invention. In FIG. 2, the electronic components of electronic control circuitry (18) are described in more detail. Contained with circuitry (18) is a timer circuit (30) and an associated frequency generator and trigger (34). Timer circuit (30) is a standard timed delay circuit (based on a 4541 type IC for example) that may be preset to a specific delay time interval or may be adjustable. In any case, timer circuit (30) is initiated by the activation door switch (14). Voltage (VCC) is provided to timer circuit (30) by way of regulated power source (12). Once the appropriate delay period has expired and timer circuit (30) activates frequency generator and trigger (34) which in turn intermittently activates horn/siren relay (39) which creates an audio alarm through horn/siren (24). The frequency characteristics of frequency generator and trigger (34) are such that a distinctive sound is created that may be associated with the door ajar condition and may be distinguished from an occupant emergency condition.

When door switch (14) activates as the door is opened, door ajar indicator (20) is immediately illuminated. This activation is made through door ajar relay (38) which can optionally pulse door ajar indicator (20) on and off making it more apparent that an alarm condition exists. Alternatively, door ajar indicator (20) and door ajar relay (38) might be functionally connected through timer circuitry (30) as are horn/siren (24) and frequency generator and trigger (34). This alternative configuration would delay the illumination of door ajar indicator (20) until the expiration of the preset period of time that also controls the operation of the audio alarm. In the preferred embodiment, however, it is anticipated that an indication of the door being open from the moment it is opened is desirable with an audio alarm being sounded after a period of time has elapsed. This would allow a simple visual reminder of the necessity to close the door, while an audible alarm would indicate that the efficiency of the appliance is being detrimentally affected by the door being open for too long a period of time.

Also shown in FIG. 2 is a more detailed description of the circuitry associated with the occupant emergency condition alarm system. Occupant emergency toggle switch (16) is or is functionally equivalent to a double pole single-throw switch that simultaneously activates occupant help indicator (22) and horn/siren unit (24). In a manner similar to the door ajar alarm system, occupant help indicator (22) is activated byway of help relay (40), and horn/siren unit (24) is activated by way of horn/siren relay (39). Help relay (40) and door ajar relay (38) which controls door ajar indicator (20) may in an alternative embodiment be strobed. It is also anticipated that door ajar indicator (20) and occupant help indicator (22) are of distinct coloration, so the rate at which these lights might be strobed is not so important as is the color associated with each alarm.

On the other hand, the frequency generate by frequency generator and trigger (34) should be distinct from 60 HZ in the preferred embodiment so as to cause horn/siren (24) to emit a distinctive sound for each of the two emergency conditions. A 60 HZ, high amplitude alarm to indicate an emergency condition within the appliance may be appropriate and could be provided by maintaining relay (39) closed, while a low frequency, high amplitude alarm could be provided by way of frequency generator and trigger (34) to indicate and provide a distinctive audio alarm for a door ajar condition.

In the case of the door ajar system, the circuitry is reset by the deactivation of door switch (14) which indicates the closing of the appliance door. Deactivating timer circuit (30) deactivates frequency generator and trigger (34) and terminates the audio alarm. Deactivation of door switch (14) automatically terminates the visual alarm seen by door ajar indicator (20).

Resetting the occupant emergency condition circuitry requires the manual deactivation of occupant emergency switch (16). Deactivating switch (16) opens help relay (40) and extinguishes help indicator (22). This also opens horn/siren relay (39) and terminates the excitation of horn/siren (24). Occupant emergency toggle switch (16) is thereafter ready to again be activated if an emergency condition exists. Door switch (14) is also again in a condition to be activated and trigger timer circuit (30) when the door is again opened.

An optional element of the system shown implemented in FIG. 2 is appliance fan motor control unit (31). Working parallel with door ajar indicator (20), fan relay (37) operates consistently with door ajar relay (38) and is likewise activated through timer (30). Appliance fan motor control unit (31) controls fan motor (29) in response to the open or closed condition of the appliance door. This control prevents a dramatic change in the internal environment of the appliance.

Figure 3:
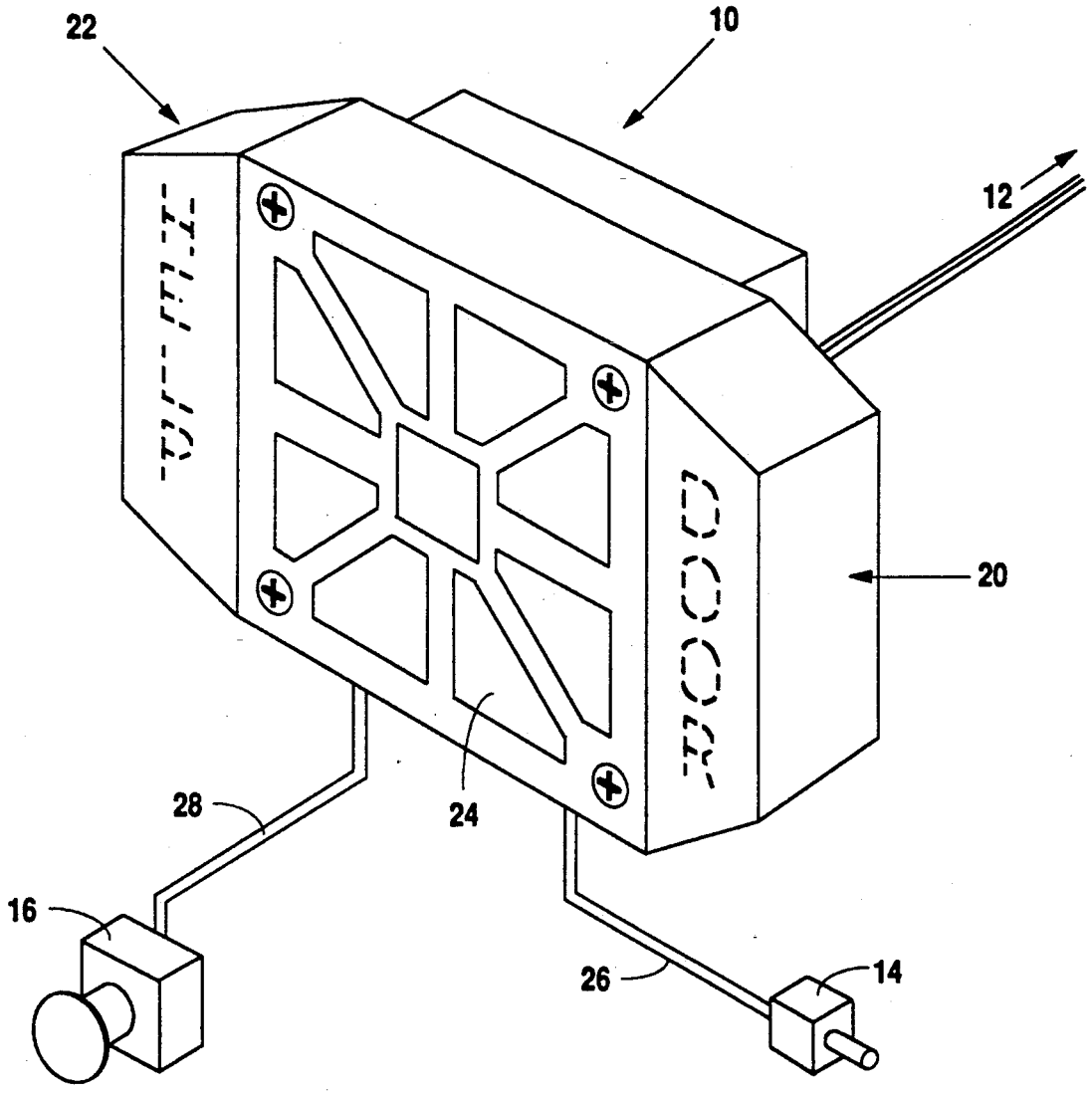
FIG. 3 is a perspective view of the cabinet configuration and the alarm indicator means shown in association with the switch connections for the apparatus of the preferred embodiment of the present invention.

Reference is now made to FIG. 3 for a detailed description of the physical characteristics of the various components of the alarm device of the present invention. The combination alarm device (10) enclosed in a single cabinet unit of a size determined by the configuration and characteristics of horn/siren speaker (24). Electronic control circuitry (not shown) is sufficiently compact that it may be completely incorporated in an enclosure of a size large enough to accommodate horn/siren speaker (24). Door ajar indicator (20) is a light unit attached to one side of combination alarm device (10), and occupant help indicator (22) is a light unit of a similar size and configuration, but is attached to an opposite side of combination alarm cabinet (10).

In the preferred embodiment, door ajar indicator (20) comprises a light lens of a distinctive coloration, white for example, while occupant help indicator (22) comprises a light lens of a second distinctive coloration, red for example. In the preferred embodiment as shown in FIG. 3, the distinctiveness of the two visual alarm indicators is further enhanced by providing wording on each light lens such that the uninformed observer of the alarm immediately is aware of the condition that is being indicated.

Although distinctive audible alarms are provided as described above, both audio alarm signals are provided by way of horn/siren unit (24) and, therefore, the speaker of this unit is centrally located between the two visual alarms.

As indicated above, electronic control circuitry (18) (not shown in FIG. 3) is fully enclosed within the cabinet structure (10) appropriately sized to house horn-/siren (24). Power supply (12) is connected by way of an appropriate electrical conductor to the electronic control circuitry (18) of combination alarm (10) and in the preferred embodiment is a typical 110 VAC, 60 Hz, electrical outlet. In an alternative embodiment, where power supply (12) provides DC voltage to the alarm unit, the conductor between power supply (12) and electronic control circuitry (18) may be of more appropriate electrical characteristics.

Door ajar switch (14) is appropriately positioned within the door jam of the freezer/refrigerator appliance door (not shown) and is connected by conductors (26) appropriate for low voltage DC electrical connection. Occupant emergency help toggle switch (16) is connected by a two pair electrical conductor (28) again appropriately sized for low voltage DC operation.

The actual installation of the device of the present invention involves mounting combination alarm cabinet unit (10) in a highly visible position adjacent to the door of the appliance. Typically this means centering the unit above the door portal for the appliance as installation conditions allow. In a preferred embodiment, where the alarm system is incorporated into the body of the appliance prior to the installation of the appliance itself, the conductors connecting door ajar switch (14) and occupant emergency help toggle switch (16) are incorporated within the walls of the appliance itself. In a retrofit situation, electrical connections to door ajar switch (14) and occupant emergency help toggle switch (16) can be made either on the exterior surface of the appliance unit or by drilling holes into the interior of the appliance unit and appropriate running the wires therein.

Occupant emergency help toggle switch (16) is positioned within the appliance convenient for an occupant to operate. Door ajar switch (14) is positioned within the door jam of the appliance such that when the door is closed, the switch is contacted and thereby deactivated, and when the door is ajar, the switch is released and thereby activated. Switch units are available that may both be retrofit or originally installed in the appliance unit.

Power supply connections to the combination alarm device (10) are typically run through conduit up to the unit when such power is supplied from a standard 110 VAC source. In some situations wherein a DC battery operated unit is desired, the battery source for the power to the unit may be mounted immediately adjacent to combination alarm device (10). In either case, it is preferable to enclose the electrical connections between the power supply and combination alarm device (10) within an appropriately sized conduit.

Although the invention has been described with respect to certain specific preferred embodiments, many variations and modifications would become apparent to those skilled in the art, after a review of the disclosure herein and the appended claims. It is the intent that the appended claims be interpreted as broadly as possible in view of the prior art to include all such variations and modifications.

I claim:

1. A combination appliance alarm system for providing indications that a door of the appliance has been left ajar and for indicating an emergency condition within the appliance, comprising:

a first "door" switch means positioned so as to be deactivated when said door of said appliance is closed and to be activated when said door of said appliance is open;

a second "help" switch means, said help switch means positioned within an interior space of said appliance, said help switch capable of being manually toggled from a normally deactivated position to an activated position;

a first visual indicator means;

a second visual indicator means;

an audio indicator means; and electronic control circuitry, said electronic control circuitry capable of detecting a deactivated or activated condition of said first switch means and of said second switch means and controlling said first visual indicator means, said second visual indicator means, and said central audio indicator means in response to said condition of said first switch means and said condition of said second switch means.

2. The combination appliance alarm system of claim 1, wherein said first visual indicator means emits light of a first color and said second visual indicator means emits light of a second color, said second color being distinct from said first color.

3. The combination appliance alarm system of claim 1, wherein said electronic control circuitry further comprises:

means for illuminating said first visual indicator means; and means for triggering said audio indicator means;

wherein said first visual indicator means and said audio indicator means are illuminated and triggered respectively by activation of said first "door" switch means.

4. The combination appliance alarm system of claim 3, wherein said electronic control circuitry further comprises timer circuitry capable of delaying said triggering of said audio indicator means a preset period of time from said activation of said first "door" switch means.

5. The combination appliance alarm system of claim 4, wherein said preset period of time in said timer circuitry is manually adjustable.

6. The combination appliance alarm system of claim 1, wherein said electronic control circuitry further comprises:

means for illuminating said second visual indicator means; and means for triggering said audio indicator means;

wherein said second visual indicator means and said central audio indicator means are illuminated and triggered respectively by activation of said second help switch means.

7. The combination appliance alarm system of claim 1, wherein said electronic control circuitry further comprises:

means for illuminating said first visual indicator means;

means for illuminating said second visual indicator means; and first means for triggering said audio indicator means;

second means for triggering said audio indicator means;

wherein said first visual indicator means and said audio indicator means are illuminated and triggered respectively by activation of said first "door" switch means, and said second visual indicator means and said audio indicator means are illuminated and triggered respectively by activation of said second it "help" switch means.

8. The combination appliance alarm system of claim 7, wherein said first means for triggering said audio indicator means creates an audio indication distinct from an audio indication created by said second means for triggering said audio indicator means.

9. The combination appliance alarm system of claim 1 further comprising means for appliance air flow control, said air flow control means responsive to activation of said first "door" switch means.

10. A combination appliance alarm system for providing indications that a door of the appliance has been left ajar and for indicating an emergency condition within the appliance, comprising:

a first "door" switch means positioned so as to be deactivated when said door of said appliance is closed and to be activated when said door of said appliance is open;

a second "help" switch means, said "help" switch means positioned within an interior space of said appliance, said "help" switch capable of being manually toggled from a normally deactivated position to an activated position;

a first visual indicator means;

a second visual indicator means;

an audio indicator means;

electronic control circuitry, said electronic control circuitry capable of detecting a deactivated or activated condition of said first switch means and of said second switch means, said electronic control circuitry comprising;

means for illuminating said first visual indicator means;

means for illuminating said second visual indicator means;

first means for triggering said audio indicator means;

second means for triggering said audio indicator means;

wherein said first visual indicator means and said audio indicator means are illuminated and triggered respectively by activation of said first "door" switch means, and said second visual indicator means and said central audio indicator means are illuminated and triggered respectively by activation of said second "help" switch means; and timer circuitry capable of delaying said triggering of said a audio indicator means a preset period of time from said activation of said first "door" switch means.

* * * * *